United States Patent [19]

Atia et al.

[11] 4,156,860

[45] May 29, 1979

[54] TEMPERATURE COMPENSATION APPARATUS FOR A RESONANT MICROWAVE CAVITY

[75] Inventors: Ali E. Atia; David Perlmutter; Paul R. Schrantz, all of Gaithersburg, Md.

[73] Assignee: Communications Satellite Corporation, Washington, D.C.

[21] Appl. No.: 821,421

[22] Filed: Aug. 3, 1977

[51] Int. Cl.[2] ..... H01P 7/06; H01P 1/30; H01P 1/16

[52] U.S. Cl. ..... 333/229; 333/228

[58] Field of Search ..... 331/96; 315/39.59; 333/82 BT, 83 T, 83 A

[56] References Cited

U.S. PATENT DOCUMENTS

| | | | |
|---|---|---|---|
| 3,048,803 | 8/1962 | Schanbacher | 333/83 T |
| 3,108,240 | 10/1963 | Riblet | 333/83 T |

*Primary Examiner*—Paul L. Gensler
*Attorney, Agent, or Firm*—William M. Wannisky

[57] ABSTRACT

A device for a resonant microwave cavity which includes a tuning plunger assembly to make the resonant frequency less temperature sensitive. The frequency response of a cavity filter, determined by its resonant frequency, primarily depends on the dimensions of the filter cavity. Since cavity dimensions will vary with changes in ambient temperature, some form of compensation is necessary to stabilize the frequency response. The tuning plunger assembly is comprised of a sandwich of materials having substantially different coefficients of expansion. One of the materials, a potting compound with a high coefficient of thermal expansion, acts as an operator to vary the configuration of the plunger assembly in order to maintain the resonant frequency of the cavity substantially fixed.

6 Claims, 5 Drawing Figures

TEMPERATURE COMPENSATION APPARATUS FOR A RESONANT MICROWAVE CAVITY

BACKGROUND OF THE INVENTION

Variations in the ambient temperature of a microwave resonant cavity have long been known to affect its performance, particularly its frequency response characteristics. As the ambient temperature increases or decreases, the material which forms the resonant cavity will expand or contract, thereby changing the dimensions of the cavity. Since the resonant frequency of a microwave cavity is a function of its dimensions, temperature variations will cause changes in the frequency at which the cavity will resonate.

At a given base temperature $T_0$ the resonant frequency f of a right angle cylindrical cavity for the $TE_{lmn}$ or the $TM_{lmn}$ mode is given by $$f = \sqrt{\left(\frac{CX_{lm}}{\pi D}\right)^2 + \left(\frac{Cn}{2L}\right)^2} \quad (1)$$

where

D is the diameter of the cavity;

L is the effective cavity length;

C is the speed of light; and $X_{lm}$ is the proper root of the Bessell function or its derivative according to the mode.

The incremental change in resonant frequency, $\Delta f$, due to incremental changes in the length, $\Delta L$, and diameter, $\Delta D$, in the cavity dimensions, caused by a temperature variation from $T_0$, can be obtained from the above equation by taking its total differential, thus:

$$\Delta f = -\frac{\left(\frac{CX_{lm}}{\pi D}\right)^2 \cdot \frac{\Delta D}{D} + \left(\frac{Cn}{2L}\right)^2 \cdot \frac{\Delta L}{L}}{f} \quad (2)$$

As the equation (2) demonstrates, frequency shift is a partial function of both cavity diameter and effective cavity length.

The problem of temperature sensitivity is evidenced in cavity filter designs at all microwave frequencies but is more pronounced at very high frequencies. Accordingly, some form of compensation must be incorporated in the filter design to achieve stability under a range of operating temperatures. The prior art solutions to the compensation problem have been generally acceptable for frequencies in the low end of the microwave spectrum, where the dimensions of the filter components are larger and impose few restrictions to compensation technique. These techniques are not satisfactory when the filters are intended for use at high frequencies such as the 11–14 GHz range employed for satellite communications. At these frequencies filter dimensions are small allowing less space for the compensation device. Accordingly, filters having a plurality of cavities often must be resorted to in order to achieve the necessary performance. However, where weight economy is a fundamental consideration such as in the design of on-board sub-systems for spacecraft, it is desirable to minimize the number of cavities required. Notwithstanding these physical limitations reliable communications' requirements demand accurate filtering of transmitted and received signals. Typical performance specifications for a satellite operating at 12 GHz allows a frequency shift of only 1 MHz. For an aluminum filter composed of several cavities operating at 12 GHz, a 40° C. temperature change would result in a frequency shift greater than 10 MHz. Frequency shifts of this magnitude are unacceptable for high quality communications satellite applications. Since variations of up to 40° C. in ambient temperature are typical of operating communications satellites, some form of temperature compensation is mandatory.

An additional problem is that high quality communications systems require filters having sharp frequency responses. That is, the slope of the rise and fall of the response curve should be as steep as possible making the curve flat in the band. However, as frequency increases relative channel bandwidth decreases. For example, a 5 MHz bandwidth is narrower relative to a 12 GHz frequency operating frequency than with respect to a 4 GHz frequency. This lower relative bandwidth allows more noise to enter the signal. Moreover, as frequency increases more loss occurs in the filter. In order to achieve satisfactory operation in the fundamental resonant mode of operation ($TE_{111}$ for a right angle cylinder, which is a low Q or high loss mode) more filter sections must be added. This is impracticable for the confines of a spacecraft application. The alternative is to utilize a less lossy or high Q mode. For a right angle cylinder cavity, the $TE_{011}$ mode is preferred at high frequencies.

Various schemes have been proposed in the prior art to compensate for the shift in resonant frequency due to temperature variation of the cavity geometry. One scheme introduces a tuning screw (or screws) into the cavity when the cavity is undergoing some dimensional change due to thermal expansion. This technique involves the insertion of a rod-like element through a cavity wall typically by way of a bi-metallic operator to affect the electromagnetic field at that location. The tuning screw alters the frequency but also causes discontinuities in the field. For example, a dielectric or metal rod would be introduced at a point where the E vector of the electromagnetic field is greatest. This forces the electric field tangential to the screw to go to zero at that point. A reduction in the total electric field of a resonant cavity will cause the frequency to decrease. U.S. Pat. No. 3,714,606, "Temperature Compensated Tuner and Oscillator," Lawrence O. Friend, issued Jan. 30, 1973 shows such a tuning screw in conjunction with a bi-metallic operator which responds to variations in ambient temperature. However, in such a device the field normal to the tuning screw is intensified and in high power applications, typically found in satellite system earth stations, voltage breakdown of the cavity medium occurs. This creates arcing-over and heat resulting in pitting of the interior cavity surface which is detrimental to optimum performance. An additional problem is that fatigue of the bi-metallic operator may reduce the lifetime of the compensation device. Furthermore, the apparatus described in the above patent is not suitable for the $TE_{011}$ mode, because introduction of a tuning screw into the cavity will deteriorate portions of the E field and cause discontinuities in the $TE_{011}$ mode. Although compensation by way of tuning screws is compatible with the $TE_{111}$ mode, it is not useable in the $TE_{011}$ mode when it is desirable to take advantage of the high Q's that mode offers.

Another technique, directed at minimizing temperature related instability rather than compensating for it, is to use a material which is substantially insensitive to variations in temperature within the range of ambient temperatures to be encountered by the filter. The most widely used of such temperature insensitive materials is Invar which exhibits exceptional dimensional stability. However, Invar is a relatively heavy metal and it is difficult to machine relative to lighter and softer materials such as aluminum or its alloys. Resonant cavity filters made of Invar, while being generally temperature insensitive, are not especially well suited for applications at high operating frequencies. Filter complexity, involving the use of multiple cavity designs, generally increases with frequency and correspondingly so does filter weight. Very high operating frequencies such as used in communications satellite would result in a filter of Invar being too bulky and heavy for efficient application. Additionally, the cost of Invar is several times greater than aluminum.

The prior art technique for temperature compensation most relevant to the instant invention involves the use of a tuning plunger having an element constructed of a material different from the cavity and/or the other plunger parts. Where the cavity is a metal such as aluminum, the plunger element generally is a dielectric such as nylon or Delrin. These materials demonstrate properties of rigidity, facile machineability and stability under most conditions. Such dielectric materials react to changes in temperature to a larger degree than the material of which the cavity and/or the other plunger parts are constructed. These plunger elements are typically in the shape of a cylindrical rod. This rod serves to vary the position of a cavity wall as a function of temperature change. One drawback with this device is the need for a carefully machined rod to operate within the close tolerances of high frequency cavity and still be structurally able to withstand the stress and vibrations encountered in spacecraft launchings. Additionally, the rod-type compensation plunger requires more operating space than that of the present invention especially at high frequencies. As is well known, as the frequency increases, the physical size of the cavity must be decreased due to the shortened wavelength. Thus the necessary length of the dielectric rod may impose a limitation on the operating frequency range of the cavity. This limitation is inconsistent with plans of expanding utilization of high frequencies. U.S. Pat. No. 3,623,146, "Temperature Compensation Cavity for a Solid State Oscillator," Yoichi Kaneko et al, issued Nov. 23, 1971 shows such a dielectric rod compensating device.

It is, therefore, an object of the present invention to provide a compact temperature compensated resonant cavity filter suitable for use in a spacecraft (with an expected lifetime equal to or greater than that of the spacecraft itself) and on the ground for high power multiplexing applications at earth stations.

It is a further object of the present invention to provide a temperature compensated resonant cavity filter which operates at the high Q, $TE_{011}$ mode.

It is still a further object of the present invention to provide a low-cost temperature compensated resonant cavity filter which is simple and inexpensive to manufacture and which provides a tuning plunger which is comprised of materials having substantially different coefficients of thermal expansion.

SUMMARY OF THE INVENTION

In order to achieve stable frequency response in higher order microwave cavity filters during temperature expansions the present invention utilizes a plunger, having a plate which forms one wall of the cavity and is comprised primarily of metal. A layer of potting material is sandwiched between the plate and an adjacent surface of the plunger. The particular potting material which is chosen must have a substantially greater coefficient of thermal expansion (or as sometimes referred to coefficient of linear expansion) than that of the material(s) of which the other plunger parts and the cavity are constructed. By utilizing this plunger construction the expansion or contraction of the resonant cavity, regardless of the construction material as long as the potting material has a high coefficient of temperature expansion relative to such construction material, may be compensated fully by corresponding expansion or contraction of the plunger assembly. The invention allows the filter to be constructed of inexpensive, lightweight but temperature sensitive materials, such as aluminum or its alloys. The easy machinability and relative light weight of aluminum makes it particularly suitable for spacecraft applications.

Since the potting material sandwiched between the plunger parts must have a high coefficient of thermal expansion relative to the cavity housing and other plunger parts, the thickness of the sandwich layer is minimized. Previous temperature compensated cavities required the use of a relatively long or large piece of a temperature-compensating dielectric rod which was generally nylon or Delrin. By providing a material such as a silicone or urethane resin potting material, the size of the mechanism for tuning the cavity can be kept relatively small. This is especially advantageous for a compact assembly suitable for spacecraft application.

An additional advantage found in the use of potting compound is the strong adhesion properties of resin. These adhesion properties permits accurate fabrication of the tuning plunger assembly without critical machining operations. Also the potting compound essentially forms the plunger assembly into a single component and minimizes the possibility of failure that a mechanically secured assembly may have especially under conditions of a space vehicle launch.

DETAILED DESCRIPTION OF THE PREFERRED EMBODIMENT

Figure 1:
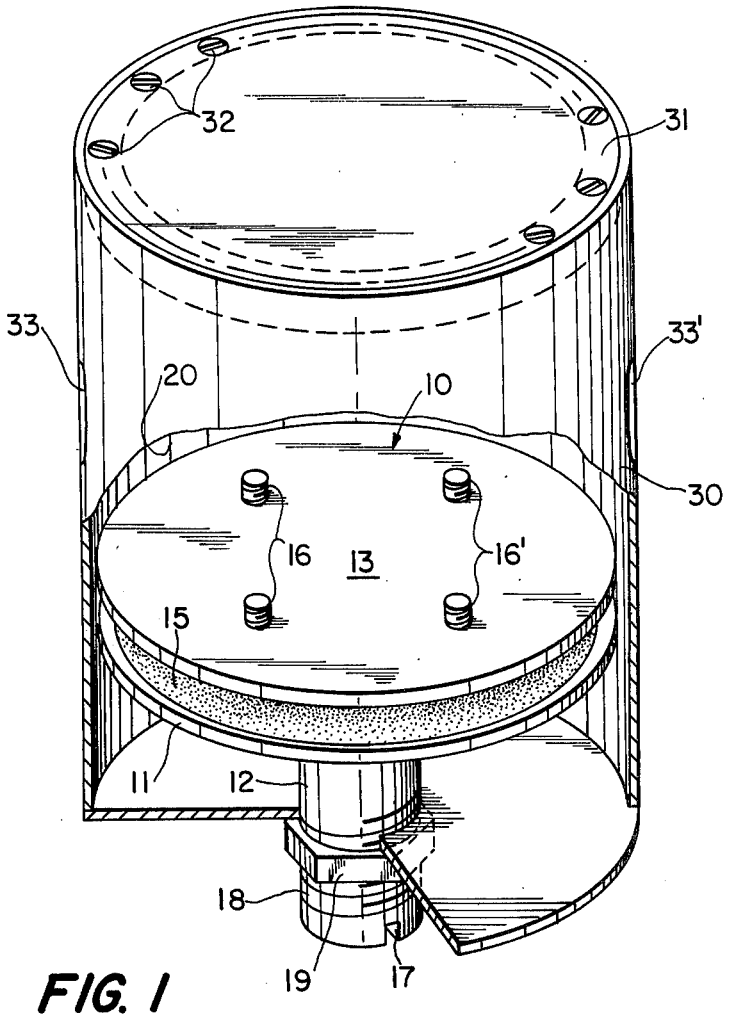
FIG. 1 is a view of a single resonant cavity employing the temperature compensation plunger of the present invention. Portions of the sidewall of the cavity are shown removed in order to view the plunger of the present invention.

The temperature compensation apparatus of the present invention may be used with any shape resonant cavity but it is particularly suitable for use with the $TE_{011}$ mode which can only be incorporated with a cylindrically-shaped cavity. The preferred embodiment shown in FIG. 1 is a temperature compensated cylindrical cavity such as may be used in a cavity filter, however, as will be clear to one of ordinary skill in the art, the teachings contained herein also apply to other cavity shapes and applications. Referring to FIG. 1, which is shown with cutaway sections to improve viewability, a single right angle cylindrical resonant cavity 20 is shown defined by housing 30 and containing a plunger assembly 10 depicted in position in the resonant cavity. The plunger assembly 10 comprises a first disc plate 11 orthogonally affixed to one end of sleeve 12 and second disc plate 13 orthogonally affixed to one end of rod 14 (not shown in FIG. 1). Plates 11 and 13 are separated by a potting material 15. Preferably, the plates are made of low-cost lightweight, readily-machinable material such as alumninum. However, Invar may be used when increased temperature stability is required at the expense of increased weight and cost. The material shown sandwiched between the plates is selected for having a high coefficient of thermal expansion relative to that of the material used for the cavity walls. Also, a substance having good adhesive quality facilitates manufacture. This includes potting compounds capable of being cured in place. Such a material is SYLGARD, manufactured by the Dow Corning Corporation, a pourable silicon resin, which has properties of high thermal expansion, good adhesion and it cures at room temperature.

Rod 14 is sized to slide within a hole in plate 11 and into tube 12 allowing plate 13 to move with respect to plate 11 with the expansion or contraction of potting material 15, while maintaining a parallel alignment between the plates. The surfaces in contact between sleeve 12 and rod 14 may be polished or machined to allow smooth operation and to minimize the possibility of binding. Since there is no electrical current between the plates and the cavity walls in the $TE_{011}$ mode, a gap may exist between the edge of the plates and the walls which would eliminate any problem of friction in that vicinity. This is not possible in the $TE_{111}$ mode which has current flowing between the cavity walls and the plate 13. If the temperature compensation device of the present invention were used in the $TE_{111}$ mode it would be necessary to insure that this contact be made for example by sizing plate 13 to having brushing contact with the interior cavity wall. Tube 12 and rod 14 provide support for the plates and assist in maintaining them in parallel alignment. Housing walls 30 define cavity 20 and preferably are made up of the same lightweight readily machinable material as the plates and their supports. Although these structures may be made of different materials, it is desirable generally to use the same material for all structures except the resin layer so that they respond in like manner to temperature changes. External threads 18 on sleeve 12 are adapted to be engaged with a compatibly threaded hole through one wall of the cavity housing 30. A slot 17 may be cut into this threaded end of sleeve 12 to receive a conventional screwdriver blade to facilitate initial tuning. Alternatively, an Allen socket or a hex head can be machined on the end of sleeve 12. Thus, through the threaded interface between the wall and the sleeve 12 the initial or $T_0$ position of the plunger assembly 10 in the cavity 20 can be adjusted by turning sleeve 12 relative to the housing 30. This adjustment is especially useful for initial tuning of the cavity. A suitable locking means such as nut 19, sized to engage the external threads on sleeve 12 and tightened against the cavity housing, secures the tube in place and prevents it from moving once initial tuning is achieved. A removable end portion 31 provides for inserting the plunger within the cavity. It may be secured in place by screws such as shown at 32. Windows or portals 33 and 33' in the housing walls 30 allow for electrically coupling the cavity to other cavities or components in a microwave transmission system in a conventional manner as understood by one having ordinary skill in the art.

In operation, a temperature increase causes the length and diameter of the cavity to increase. At the same time the potting compound 15 between the plunger expands at a greater rate than the material forming the cavity housing forcing the second or the more interior plate 13 further into the cavity to maintain the volume of the cavity relatively constant, resulting in a relatively constant resonant frequency. A temperature decrease cause the length and diameter of the cavity to decrease. In like fashion the potting compound will contract at a greater rate than the material forming the cavity housing. This will cause the more interior plate to move away from the cavity and again maintain the volume of the cavity relatively constant to result in a relatively constant resonant frequency.

Figure 2:
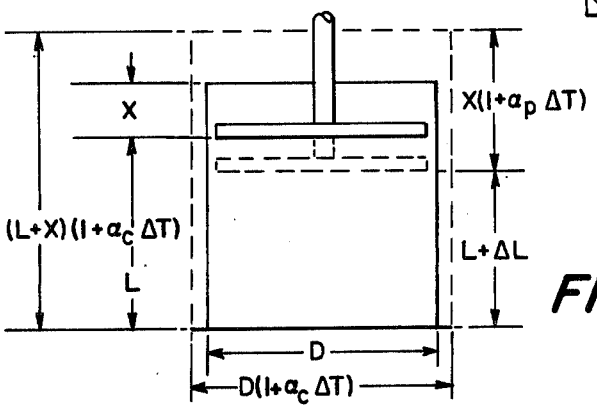
FIG. 2 is a diagram showing the geometry of a simplified temperature compensated cavity.

To ascertain the dimensions of a temperature compensated resonant microwave cavity according to the teachings of the present invention, Equation 2 must be solved to give the thickness of the potting material. A diagram of the cavity shown in FIG. 1 is depicted in FIG. 2 as having a diameter D and a length L+x at $T_0$. The tuning plunger penetrates the cavity to a depth x so that the effective cavity length is L. It is assumed here that the same material comprises the filter housing and all plunger parts but for the potting material. This being the case, the only change in x relative to the cavity length due to temperature variation is attributable to the potting material. Thus, a temperature change $\Delta T$ will cause dimensional variations of cavity and the plunger. While it is necessary to consider the changes $\Delta D$ and $\Delta L$, the change in the cavity wall thickness is not significant for this analysis.

In order to determine what thickness of potting compound will create a zero frequency shift, $\Delta f$ is set equal to 0 in Equation 2. The equation is then solved for $\Delta L/L$ and $\Delta D/D$ resulting in the following relationship:

$$\frac{\frac{\Delta L}{\Delta L}}{\frac{\Delta D}{D}} = -\frac{\left(\frac{CX_{1m}}{\pi D}\right)^2}{\left(\frac{Cn}{2L}\right)^2} = -\left(\frac{2X_{1m}L}{n\pi D}\right)^2 \tag{3}$$

It is known generally that thermal expansion may be defined by $$\Delta u = \alpha_u u \Delta T \tag{4}$$

where u represents some dimension of an expansible substance at $T_0$ and $\alpha_u$ is given for the material making up the expansible substance. With this in mind, the change of the cavity diameter would be $$\Delta D = \alpha_c D \Delta T \tag{5}$$

where $\alpha_c$ is the effective coefficient of thermal (or linear) expansion of the cavity material. Consequently $$\Delta D/D = \alpha_c \Delta T \tag{6}$$

From FIG. 2 it is seen that:

$$L + \Delta L = (L+x)(1+\alpha_c \cdot \Delta T) - x(1+\alpha_p \cdot \Delta T) \quad (7)$$

where $\alpha_p$ is the effective coefficient of thermal expansion of the plunger. Since in the preferred embodiment the only variation of the plunger dimension with respect to the housing is attributable to the potting material, $\alpha_p$ may be the effective coefficient of thermal expansion of the potting material. Solving Equation (7) for $\Delta L/L$ yields $$\frac{\Delta L}{L} = \left[\alpha_c + \frac{x}{L}(\alpha_c - \alpha_p)\right]\Delta T \quad (8)$$

Substituting Equations (8) and (6) into (3) and solving for $\alpha_p/\alpha_c$ gives $$\frac{\alpha_p}{\alpha_c} = 1 + \frac{L}{x}\left[1 + \left(\frac{2X_{1m}L}{n\pi D}\right)^2\right] \quad (9)$$

Equation 9 gives the ratio of the effective linear coefficients of expansion of the plunger and the cavity in order to achieve complete temperature compensation.

For the $TE_{011}$ mode, $X_{lm} = 3.832$, n = 1 and Equation (9) becomes:

$$\frac{\alpha_p}{\alpha_c} = 1 + \left(\frac{L}{x}\right)\left[1 + 5.951\left(\frac{L}{D}\right)^2\right] \quad (10)$$

and $$x = \frac{L\left[1 + 5.951\left(\frac{L}{D}\right)^2\right]}{\frac{\alpha_p}{\alpha_c} - 1} \quad (11)$$

Generally, values for L and D are selected for convenience or in order to avoid some electrical characteristic associated with a particular geometry. Also in a preferred embodiment $\alpha_p$ is taken for SYLGARD and $\alpha_c$ is taken for aluminum or an aluminum alloy. As can be seen from Equation (10), if the cavity structure were fabricated of aluminum the value for $\alpha_p/\alpha_c$ different from that calculated with INVAR would result. Values for $\alpha_p$ and $\alpha_c$ can be obtained from tables found in reference sources such as *Materials Selector* '74, Mid-September 1973, volume 78, number 4 published by Reinhold Publishing Company or other sources well known in the art. Where the plunger plates and support(s) are made of a material or materials different from the cavity housing an effective $\alpha_p$ must be determined. This may be done by using an experimental model from which measurements are taken for a given $\Delta T$. Solving Equation (4) by using the measured equivalent values of u, $\Delta u$ and $\Delta T$ will give the effective $\alpha_p$ for the combination of materials used in the plunger assembly. The required thickness of the potting material, x, for a zero frequency shift can then be written as an equation in terms of the effective $\alpha_p$ and other values either known or measured from the experimental model.

In operation, generally, a single cavity assembly is used as an oscillator while multiple cavity devices are used for filter purposes. Each cavity operates as a resonant circuit and each window connecting the cavities functions as a mutual inductance coupling element. The length and diameter of the cavities determine the resonant frequencies as discussed earlier, and the dimensions of the windows determine the value of the couplings. A general discussion of the mechanical and electrical characteristics of multiple cavity filters appears in U.S. Pat. No. 3,969,692, "Generalized Waveguide Bandpass Filters," A. E. Williams and A. E. Atia, issued July 13, 1976.

By analysis of an electrical equivalent circuit of the filter assembly, one can see that by proper choice of coupling coefficients a desired filter response can be obtained. The method of analysis and synthesis for filters generally is described in detail in a published paper entitled, "Narrow-band Multiple Coupled Cavity Synthesis," by A. E. Atia, A. E. Williams, and R. W. Newcomb, in the *IEEE Transactions on Circuits and Systems*, Volume CAS, No. 5, September, 1974.

The cavity shown in FIG. 1 is designed to operate in the $TE_{011}$ mode, which is a high Q or low loss mode. However, a lower Q mode, the $TM_{011}$ mode, can resonate simultaneously with the $TE_{011}$ mode in an unperturbed cavity. This would result in a sharing of the microwave energy with irregularities in the cavity performance. In order to minimize the effect of the $TM_{011}$ mode, surface discontinuities or projections 16, extend from the second plate 13 into the cavity 20. These projections are spaced concentrically at even-spaced radial positions where the axial electric field of the $TM_{011}$ mode would be maximum, but the electric field of the $TE_{011}$ mode is zero. The effect of the projections is therefore to lower the resonant frequency of the $TM_{011}$ mode considerably thus providing a pure $TE_{011}$ mode cavity. The projections may be an intergral part of the second plate or separate pieces to be positioned on the second plate as for example, machine screws threadably engaged with the plate or alternatively small rod sections in interference fit with a hole in the plate. Four such projections are shown in FIG. 1 located at 90° intervals and at the same radial location to affect the magnetic field equally. Generally, they should be symmetrically positioned; however, the number and positioning of these discontinuities are chosen in a manner known in the art and is not a part of the present invention. Typically, the projections should be quite small to avoid disturbing the $TE_{011}$ mode. Lengths on the order of 2.54 mm are compatible with the $TE_{011}$ mode and have been shown to be effective.

Figure 4:
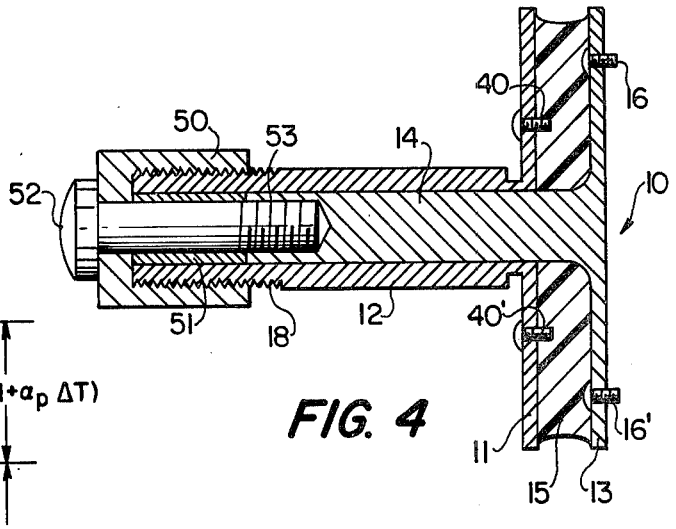
FIG. 4 is a section view of the temperature compensation plunger of the present invention which shows additional features used in the fabrication of the plunger.
Figure 3A:
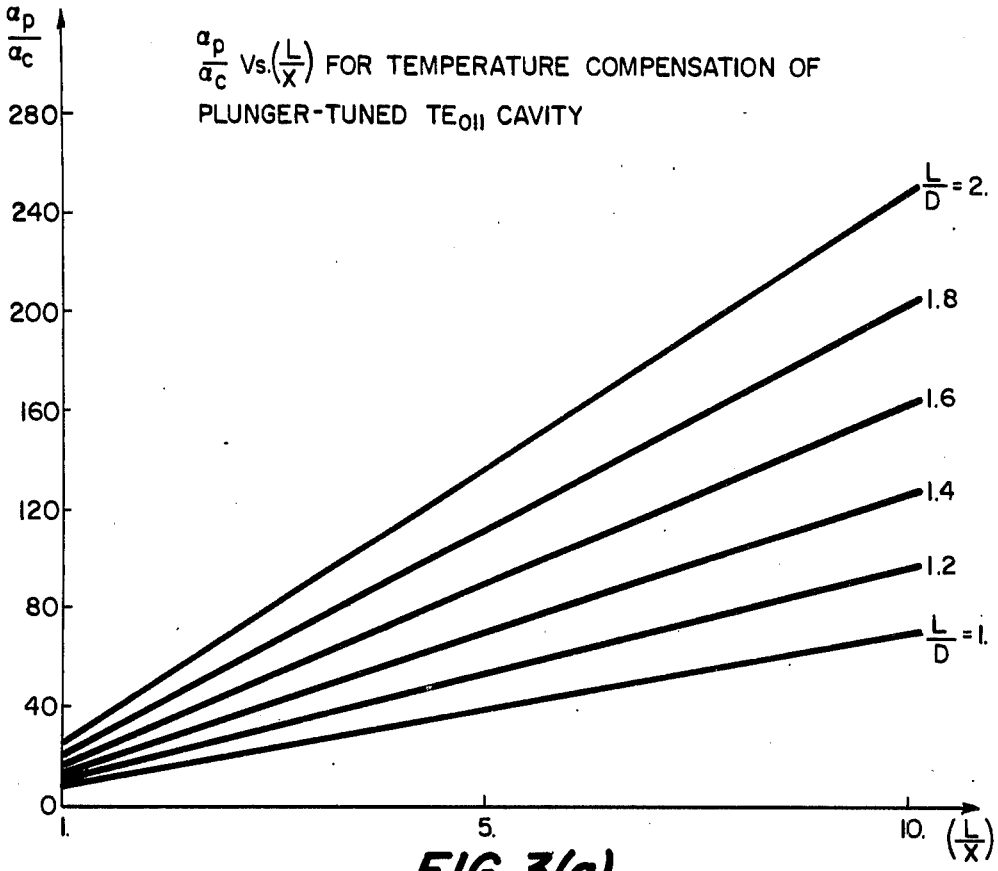
FIGS. 3*a* and 3*b* show families of curves for $\alpha p/\alpha c$ versus L/X for different values of L/D, and D/L respectively.
Figure 3B:
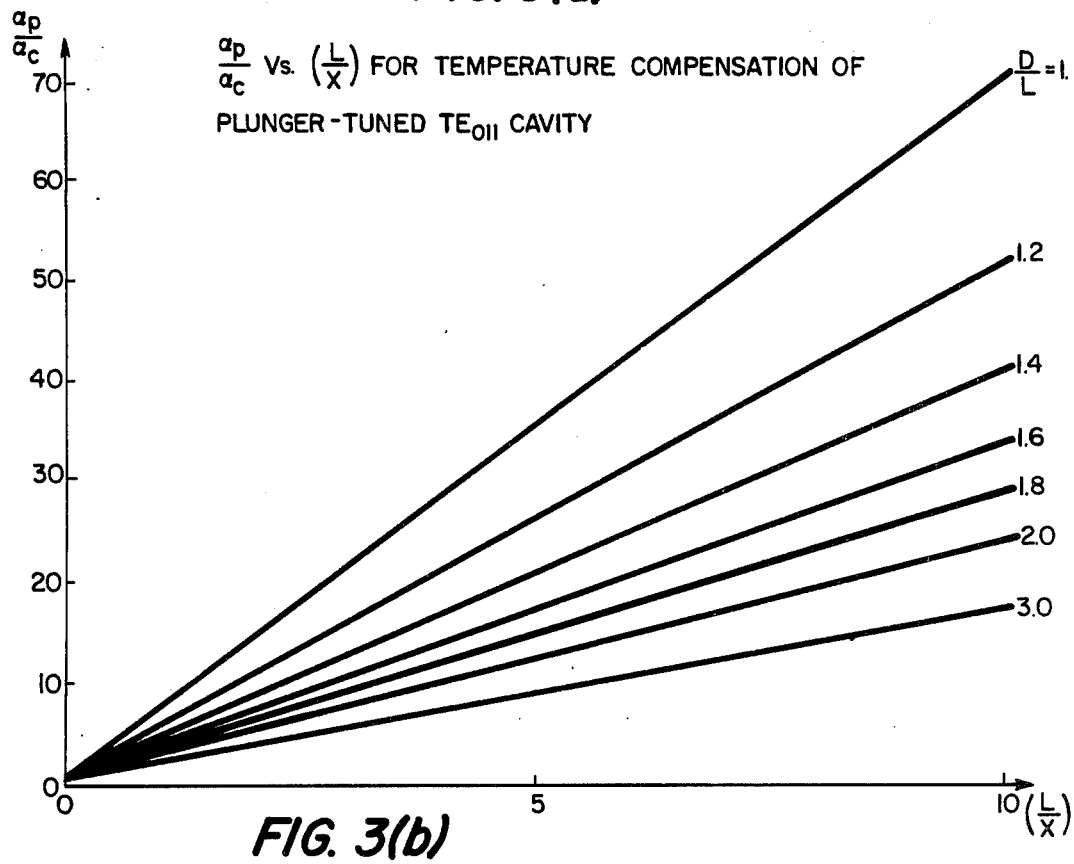

FIG. 4 shows a potting assembly for the subject invention with an alternative embodiment of plate 11. Projections 40 extend from plate 11 into the dielectric potting compound 15. The use of a good heat conducting material for the projections enhances thermal transfer to the dielectric compound. Accordingly, the compound responds more quickly to variations in temperature and the response of the plunger assembly 13 is improved. These projections 40 may be threaded into the first plate and made of the same material used for the filter walls and/or plates if it is a good heat conductor, such as aluminum. Although the projections 40 are shown in the form of a screw threaded into the plate 11, many alternatives would be recognized by one having ordinary skill in the art, such as small rods pressed into a hole in a manner described previously for projections 16.

The potting assembly for fabricating the plunger of the present invention consists of a cap 50 adapted to fit over sleeve 12 and having an internal thread engaged with the thread 18 on sleeve 12. Cap 50 is rotated until it rests securely against the sleeve. Spacer sleeve 51 inserted within the sleeve 12, abuts rod 14 and maintains rod 14 at a pre-determined distance equal to the desired potting compound material from cap 50 on sleeve 12. Rod 14 is secured in position by means of screw 52 which passed through a hole in cap 50 and through spacer 51 and engages with an interior threaded hole 53 at the end of rod 14. By tightening screw 52, rod 14 is secured at a predetermined distance from cap 50. As a result, the predetermined distance between the plates can be achieved prior to potting of the plunger by selecting the spacer sleeve of proper dimension. With the cap and screw securely in position the plates will be locked at the specified distance. For example, if sleeve 12 and rod 14 were sized to terminate evenly when their respective plates were intimately adjacent each other, the insertion of a 2.5 mm spacer sleeve 51 between rod 14 and cap 50 would result in the plates being separated by a distance of 2.5 mm. The potting compound is poured into and fills the space between the plates and allowed to cure. As the potting material cures slight shrinking of the material will occur and cause it to recess from the plate's edge. The amount of shrinkage is known for each potting material and final volume of compound desired can be achieved by taking into account the expected shrinkage. This recess between the plunger plate edges ensures that the lateral expansion with temperature of the potting compound will not cause the plunger assembly to bind because of contact with the cavity walls. After the compound is set the cap 50, spacer sleeve 51 and screw 52 are removed from the plunger assembly prior to its insertion in the resonant cavity. The adhesive nature of the potting compound binds the two plates together at the specified distance in a sandwich-like manner but since the plates are not otherwise secured, plate 13 is free to move relative to fixed plate 11 within the cavity with the expansion or contraction of the potting compound. Thus it can be seen that the adhesive qualities of the potting compound are used to secure plate 13 to plate 11 allowing for movement of rod 14 within sleeve 12 with the dimensional variation of the potting compound.

A test of compensated and uncompensated cavities demonstrated the significance of the present invention. These comparative results were obtained with a right angle cylindrical cavity geometry having diameter 36.07 mm; length (interior plate to cylinder end) 24.13 mm and silicone resin thickness (SYLGARD) of 3.70 mm. The all aluminum cavity was operated in the $TE_{011}$ mode at 12 GHz. The measured frequency shifts demonstrated that an uncompensated cavity assembly would be unacceptable for a system allowing for only nominal instability such as in satellite communications systems. For example, for a 40° C. temperature variation the uncompensated filter showed almost 10 MHz shift while the compensated filter only shifts 0.5 MHz. Thus, the compensated filter according to the present invention demonstrates a high order of stability and was within acceptable tolerance for satellite communications.

As seen from the foregoing description what has been described is a simple, low-cost and lightweight temperature compensating plunger assembly suitable for use in systems requiring the strictest tolerance. The device is suitable especially for spacecraft because of its small size and weight and uncomplicated mechanism insuring troublefree operation.

Having described our invention, what we claim is:

1. A temperature compensated resonant microwave cavity including apparatus for minimizing center frequency drift comprising:

an enclosure defining said cavity and constructed of a first material;

a first plate positioned within said cavity by a support means;

a second plate positioned within said cavity parallel to and spaced apart internally within said cavity from said first plate;

a potting compound comprising a second material sandwiched between said first and second plates and adhesively securing said second plate to said first plate;

said first and second plates and potting compound forming a tuning plunger for said cavity;

said plunger and support having an effective coefficient of thermal expansion substantially greater than that of the first material.

2. The apparatus of claim 1 wherein said support means has one end affixed to said first plate and has its opposite end affixed to said enclosure.

3. The apparatus of claim 2 wherein said support means is a tube and said second plate is affixed to a rod which is sized to pass through a hole in said first plate and into said tube whereby said potting compound is cast and cured around said rod.

4. The apparatus of claim 1 wherein said first and second plate and support means are constructed of said first material, which comprises a metal characterized by a first coefficient of thermal expansion, $\alpha_c$, and said second material comprises a resin characterized by a second coefficient of thermal expansion, $\alpha_p$, satisfying the ratio:

$$\frac{\alpha_p}{\alpha_c} = 1 + \frac{L}{x}\left[1 + \left(\frac{2X_{lm}L}{n\,\pi D}\right)^2\right]$$

where n, m, l may describe either the $TM_{lmn}$ or $TE_{lmn}$ mode of the cavity; L and D are the effective length and diameter of the cavity respectively, x, is the thickness of the second material, and $X_{lm}$ is the proper root of the Bessel function or its derivative according to the mode.

5. The apparatus of claim 1 wherein a plurality of projections extend internally from said second plate into said cavity, said projections being spaced evenly and concentrically about the center of said second plate.

6. Apparatus for temperature compensation of a microwave resonant cavity for the $TE_{011}$ mode, comprising:

a cavity, having a diameter D and an effective length L, made of a first material having a coefficient of thermal expansion $\alpha_c$;

a tuning assembly supported within said cavity having at least one pair of plates made of said first material and sandwiching a layer of resin having an effective coefficient of thermal expansion, $\alpha_p$ and having a thickness x satisfying the equation.

$$x = \frac{L\left[1 + 5.951\left(\frac{L}{D}\right)^2\right]}{\left(\frac{\alpha_p}{\alpha_c} - 1\right)}$$

* * * * *